United States Patent [19]

Champeau

[11] 4,109,331

[45] Aug. 29, 1978

[54] BED HAVING ACOUSTICAL ISOLATION

[76] Inventor: André Champeau, 7, rue Pavis de Chavannes, 75007 Paris, France

[21] Appl. No.: 737,182

[22] Filed: Nov. 1, 1976

[30] Foreign Application Priority Data

Nov. 7, 1975 [FR] France ..... 75 34169

[51] Int. Cl.[2] ..... A47C 21/04

[52] U.S. Cl. ..... 5/284; 5/309; 5/362

[58] Field of Search ..... 5/97, 284, 309, 362, 5/2; 52/66, 72, 144; 181/72

[56] References Cited

U.S. PATENT DOCUMENTS

| | | | |
|---|---|---|---|
| 1,594,256 | 7/1926 | Greene | 5/97 |
| 3,100,900 | 10/1963 | Sidebotharn | 5/284 |
| 3,229,429 | 1/1966 | Conrad | 52/2 |
| 3,345,985 | 10/1967 | Fisher | 5/362 |
| 3,680,156 | 8/1972 | McKee et al. | 5/309 |
| 3,713,182 | 1/1973 | McNeal | 5/362 |
| 3,748,799 | 7/1973 | Tough et al. | 52/144 |

*Primary Examiner*—Casmir A. Nunberg
*Attorney, Agent, or Firm*—Haseltine, Lake & Waters

[57] ABSTRACT

A bed comprising a frame, a mattress supported on the frame, and at the head of the bed a closure or chamber composed of two shell portions, to wit, a fixed lower portion fixed to the frame and a movable portion movable between an open position where it is retracted on the fixed portion and provides free access to the head of the bed and a closed position in which it leaves only a small opening towards the foot of the bed. Each shell portion of the chamber is constituted by a rigid frame covered with a sound insulating material and a sound absorbing material. The movable portion is itself constituted by two parts articulated to one another and to the fixed portion around a common horizontal transverse axis. One part of the movable portion is transparent and capable of being retracted into the other part which is opaque.

6 Claims, 3 Drawing Figures

BED HAVING ACOUSTICAL ISOLATION

FIELD OF THE INVENTION

The invention relates to a bed and more particularly to a bed which is acoustically isolated from the ambient environment.

BACKGROUND

Noise has become a major source of nuisance in great urban centers and even in the smallest villages, for example, those traversed by roads with high traffic density or situated in the vicinity of airports. The noise is much more apparent and objectionable at night when it can seriously disturb sleep.

It must be unfortunately concluded that current homes have not been conceived to assure an effective protection against noise. A better isolation of the openings in homes leads generally to a lack of ventilation which can be as unacceptable in certain cases as the perceived noise when the windows are open. Only in rare modern buildings which are well insulated and provided with a system of air conditioning can the nuisance due to noise be reduced to an acceptable level on the condition, of course, that the noise level of the air conditioning system is itself acceptable.

SUMMARY OF THE INVENTION

An object of the present invention is to provide means to overcome the imperfections of sound isolation of a home such as presently exist taking into account that it is hardly possible to eliminate this without the cost of considerable investment. To permit rest and normal sleep in a house poorly insulated from the noisy environment, the invention contemplates a bed acoustically isolating the occupant from the immediate exterior environment while also isolating the occupant from outside noise which could be transmitted to him.

The invention is applicable to a bed comprising a frame supporting a box spring and a mattress and according to the invention the portion of the frame forming the head of the bed is engaged in a chamber composed of two parts, i.e. a lower part fixed to the frame and an upper part movable between an open position where it is telescoped on the fixed part and provides access to the head of the bed and a closed position in which it leaves only a small opening towards the front, each part of the chamber being constituted by a rigid frame covered with a sound insulating material and a sound absorbant material.

According to a particular embodiment of the invention, the bed comprises a ventilation device constituted by a ventilator fan actin through the wall of the fixed portion of the chamber at a level below that of the bed frame and a grill with a filter disposed at the level of the bed frame at the head of the bed.

According to a preferential embodiment of the invention, the bed frame is also constituted by a rigid member covered with a sound insulating material and a sound absorbant material.

The invention is next going to be described in greater detail with reference to a particular embodiment given by way of example and shown in the annexed drawings.

DETAILED DESCRIPTION

Figure 1:
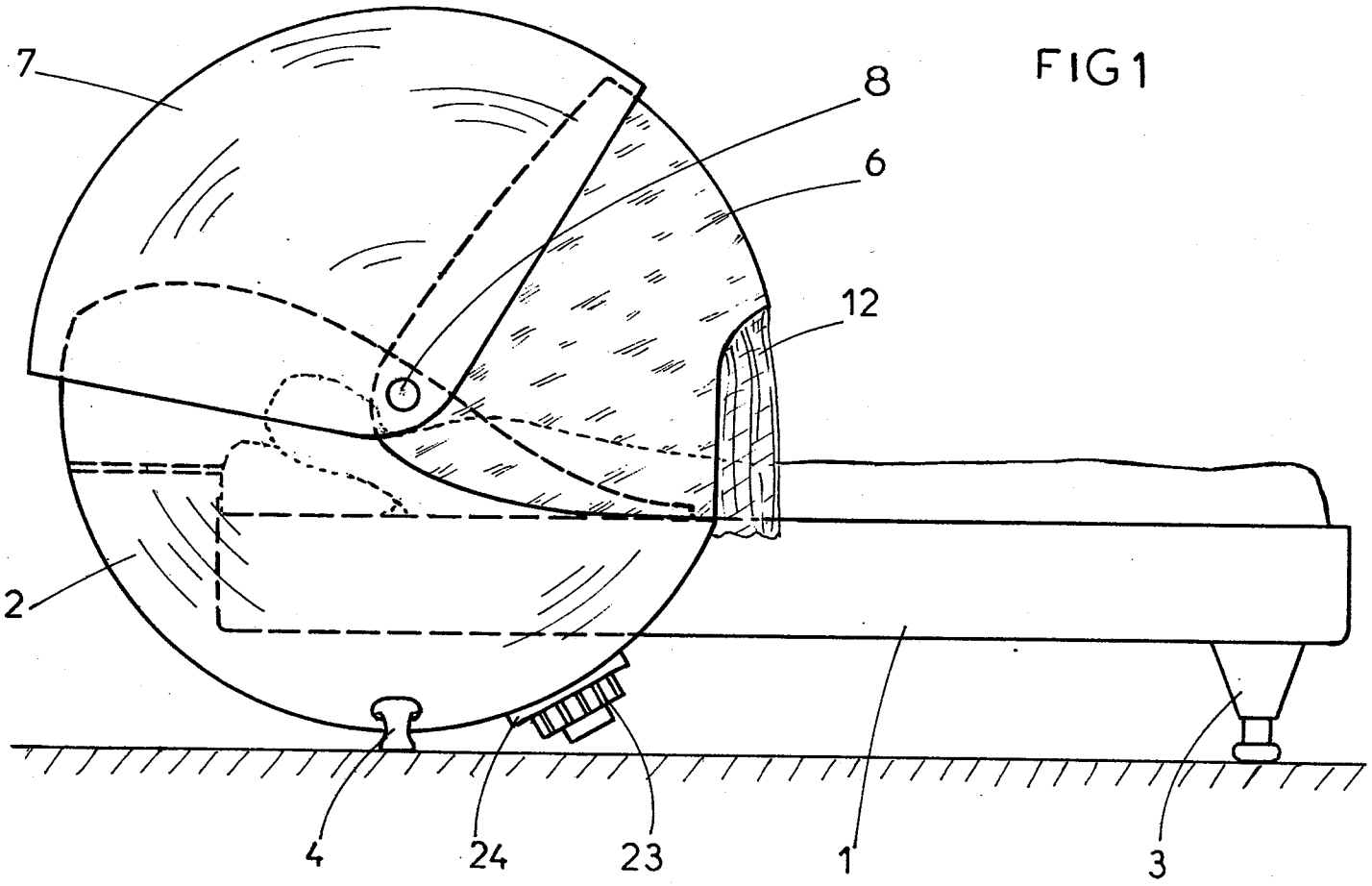
FIG. 1 is a side elevational view of a bed according to the invention shown in closed position.

With reference to the drawing, therein is seen a bed comprising a rectangular bed frame 1 supporting a mattress and the head of the bed frame is engaged in a spherical chamber whereas the foot of the bed frame is directly supported on the ground by means of feet 3. A fixed lower part or shell 2 of the chamber also rests on the ground by means of feet 4. The feet 3 and 4 are composed of shock absorbing material thus assuring isolation with respect to vibration of the ground. An upper part of the spherical chamber is constituted by two movable portions 6 and 7 in the form of spherical shells articulated with respect to one another and to the lower shell 2 around a common horizontal transverse axis defined by pivot shafts and for simplification of the drawing the axis of articulation is only represented by bosses 8 supported on the pivot shafts. The shell 6 is made of a transparent material such as PLEXIGLAS or the like. The shells 2 and 7 are opaque.

Figure 2:
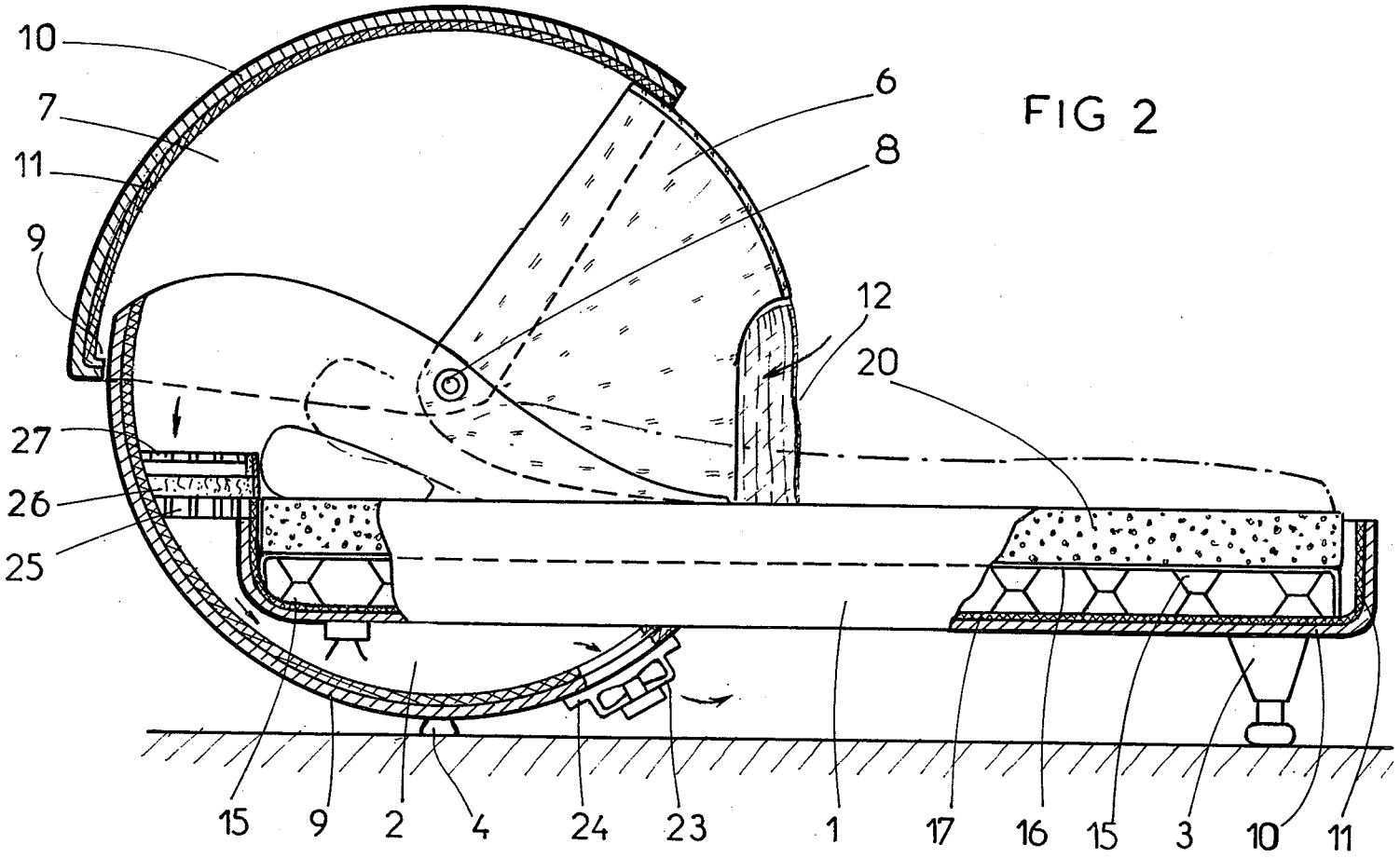
FIG. 2 is a longitudinal section taken along line II—II in FIG. 3.

As seen in the closed position represented in FIGS. 1 and 2, the three shells 2, 6 and 7 substantially completely enclose the head of the bed in the form of a sphere whose center is very close to the level of the head of the sleeper (whose outline is diagrammatically shown). In open position, in contrast, the upper shell 6 is retracted into the shell 7 up to edge 9 thereof which forms an abutment and the assembly of shells 6 and 7 can be retracted or telescoped on the exterior of the shell 2 thereby providing a major open region at the front for easy access to the bed. Of course, although not shown in the drawing, the movable shells 6 and 7 are provided with conventional handling means to permit their easy movement, e.g. simple handles or the like.

Each of the two shells 2 and 7 are constituted by a rigid frame of a hard material producing reflection of acoustical waves towards the exterior and reducing to a maximum their penetration into the chamber. Such materials could be, for example, resins reinforced or not with various fibers, PLEXIGLAS, or compositions of wood and plastic material. One could also utilize the same type of rigid material for the frame 7 of the bed.

Internally, the shells 2 and 7 and the frame 1 are covered by a layer 10 of sound insulating material, such as, for example, material known under the trademark NORSOREX. The covering 10 is in turn covered by a sound absorbant layer of material 11 such as, for example, polyurethane foam having open cells.

The insulation of the assembly of the elements of the spherical chamber can be completed by a curtain 12 covering an opening left free by the transparent shell 6. The curtain 12 has a large mesh to allow the air to pass freely and can serve as a protection against mosquitoes and other insects.

The bed frame 1 supports a box spring constituted by an assembly of flat elastic shock absorber elements 15 covered by an upper envelope 16 which is elastic and insulating. The shock absorber elements 15 are enclosed at their lower ends in corresponding housings 17 of the bed frame and thus maintained in position. The mattress 20 which rests on the box spring is formed, at least partially, of an elastomeric cellular structure comprising a substantial proportion of open cells which also contributes to the absorption of noise.

The assembly of the elements which have just been described provides in the central zone of the chamber enclosing the head of the bed, i.e. in the region where the head of the occupant is normally found, a reduction of noise of a mean value of 20 decibels and if any noise exists in the interior of the cell it is one whose spectrum differs substantially from that of the exterior noise and whose characteristics no longer present a nuisance but in contrast provide an effect of securing quietude.

The comfort of the occupant also requires ventilation of the closed chamber during sleep. The ventilation is obtained by means of an electric fan 23 having a low level of noise and a variable speed fixed to the shell 2 through the intermediary of a shock absorbing and sound insulating support 24. Air is aspirated into the lower chamber under the bed frame through a grill 25 supporting a removable pad 26 formed of a filtering and sound absorbant material. A safety grill 27 prevents the fall of objects into the filter. The suction of the ventilator 23 causes air to enter the chamber through the mesh of the curtain 12 and to flow through the chamber and into the lower shell via pad 26 for ultimate exhaust at fan 23. The arrows in FIG. 2 indicate approximately the flow of air through the chamber.

Any possible sensation of claustrophobia which might be felt by certain persons is avoided by the transparency of the shell 6, this being also slightly tinted to attenuate the effect of a light exterior.

Figure 3:
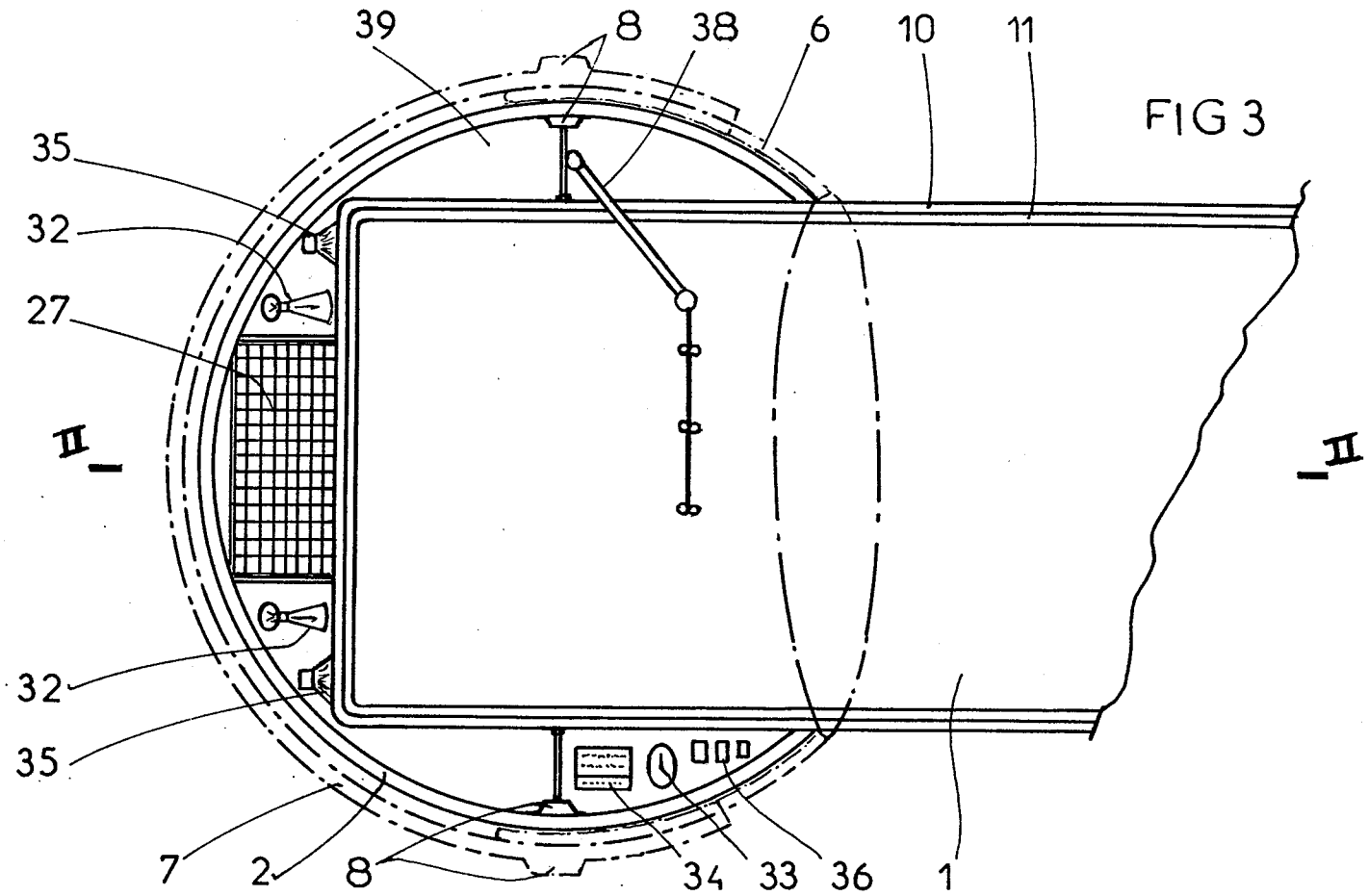
FIG. 3 is a top plan view of a portion of the bed and in which a movable upper part is in raised position.

Finally, the assembly can be completed by various accessories permitting the occupant to dispose in the interior of the accoustically isolated chamber all elements which are conventionally disposed in the vicinity of a normal bed. Thus, there is shown in FIG. 3 lighting apparatus 32, a clock alarm 33, preferably electrical and of low noise level, a radio 34 with loud speakers 35 incorporated in the shell and various control buttons 36 for operation of the diverse apparatus and for regulation of the speed of the fan 23. Further contemplated is a retractable arm 38 with braces or supports for holding books in a reading position. Finally, the space between the bed frame 1 and the lower wall of the shell 2 is closed by shelves 39 which, for example, can serve as storage surfaces for various objects within reach of the occupant.

Of course, the invention is not limited to the embodiment which has just been described by way of example, but it also covers other embodiments which are different only in details by variant of execution or by the utilization of equivalent means. Thus, although the spherical form of the chamber is that taken best for attenuation of noise, one could also utilize other shapes permitting the retraction of a movable portion on a fixed portion. For a double bed, one could, for example, provide the general form of an ellipsoid of revolution or a cylindrical shape.

Furthermore, one could replace the forced ventilation system by a ventilator having natural ventilation by providing small openings in the upper shell 7, for example, of a diameter of 1 mm, sufficient to assure a free circulation of air but too small to permit the transmission of sound.

The upper movable portion of the chamber could be a single piece, the transparent portion then being replaced by a port hole disposed at the front of the movable shell.

What is claimed is:

1. A bed comprising a bed frame, means on said frame providing a sleeping surface, said frame having a head end and a foot end, means at said head end of the bed forming a chamber and including first and second parts, said first part being fixed to said frame, said second part being mounted on said first part for movement between an open position in which the second part is retracted on the first part and a closed position in which the second part is extended from the first part and defines a small opening facing the foot end of the frame, said first and second parts being constituted respectively by a rigid frame, and a sound insulating material and a sound absorbent material on said rigid frame, means for ventilating said chamber, said chamber having a spherical shape with a center in the vicinity of the head of an occupant of the bed, and means connecting said first and second parts for relative articulated movement around a horizontal transverse axis, said bed frame comprising a rigid base portion covered by a sound insulating material and a sound absorbing material.

2. A bed as claimed in claim 1 wherein said means for ventilating said chamber comprises a fan for aspirating air from said chamber via said fixed part at a level below said bed frame and air filter means at the head end of the bed at the level of the bed frame.

3. A bed as claimed in claim 1 wherein said second movable part comprises first and second portions connected for pivotal movement relative to one another and to said first fixed part around said axis, said first portion of the second movable part being opaque, the second portion of the second movable part being transparent and retractable into said first portion.

4. A bed as claimed in claim 1 comprising a curtain with a wide mesh on said second part covering said opening.

5. A bed as claimed in claim 1 wherein said means on the frame providing a sleeping surface comprises a box spring including flat elastic shock absorber members, and an upper envelope fixed to said shock absorber members, said bed frame having housings in which the lower ends of the shock absorber members are secured.

6. A bed as claimed in claim 1 comprising and vibration absorber supports on said bed frame and chamber.

* * * * *